United States Patent [19]

Cassia

[11] 4,146,156

[45] Mar. 27, 1979

[54] SOAP DISPENSING SYSTEM

[75] Inventor: Antonio M. Cassia, La Milan, Italy

[73] Assignee: Steiner American Corporation, Salt Lake City, Utah

[21] Appl. No.: 851,467

[22] Filed: Nov. 14, 1977

Related U.S. Application Data

[62] Division of Ser. No. 719,924, Sep. 2, 1976, abandoned.

[30] Foreign Application Priority Data

Feb. 3, 1976 [IT] Italy ..... 19848A/76

[51] Int. Cl.[2] ..... B67D 5/06

[52] U.S. Cl. ..... 222/181; 222/192; 248/309 R; 141/330

[58] Field of Search ..... 222/173, 180, 181, 185, 222/192; 248/309, 310, 311; 141/330

[56] References Cited

U.S. PATENT DOCUMENTS

| | | | |
|---|---|---|---|
| 1,223,172 | 4/1917 | Jacobson | 222/192 X |
| 1,886,288 | 11/1932 | McDow | 222/181 |
| 3,220,613 | 11/1965 | Palmer et al. | 222/180 X |
| 3,220,616 | 11/1965 | Jennings | 222/181 X |
| 3,540,630 | 11/1970 | Brown et al. | 222/181 X |
| 3,627,248 | 12/1971 | Nelson | 248/309 |
| 3,970,121 | 7/1976 | Brandt | 141/330 X |
| 4,018,363 | 4/1977 | Cassia | 222/181 X |

*Primary Examiner*—Joseph J. Rolla
*Attorney, Agent, or Firm*—Vogel, Dithmar, Stotland, Stratman & Levy

[57] ABSTRACT

A liquid soap dispensing system includes a closed soap container having a manually actuated dispensing pump carried therebeneath and being mounted on a bracket which has support fingers engageable with a lip on the container bottom for supporting it and a flexible retaining finger engageable with a groove in the top of the container for releasably holding it immovably against the bracket. A bottom wall extends from the bracket beneath the container and cooperates therewith to enclose the dispensing pump and is provided with an aperture to accommodate dispensing of soap therethrough. Refill of the container is by a plastic refill squeeze-bottle with a neck closed by a membrane. The neck is inserted in a well in the top of the container, and a piercing member at the bottom of the well ruptures the membrane, whereupon soap may be squeezed from the bottle and through apertures in the well bottom, which apertures are too small to permit ready flow of soap therethrough by gravity at ambient pressure. Seal flanges on the bottleneck engage the well sides to prevent soap from being squeezed up around the neck and out of the well. A latchable cover plate covers the container well and has formed therein an ashtray and cigarette holder.

11 Claims, 13 Drawing Figures

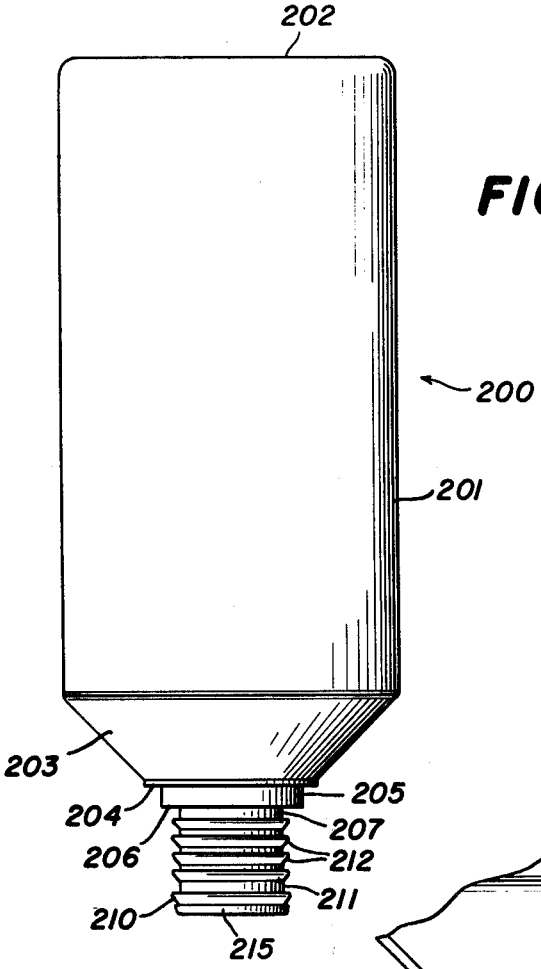
FIG. 6
FIG. 8
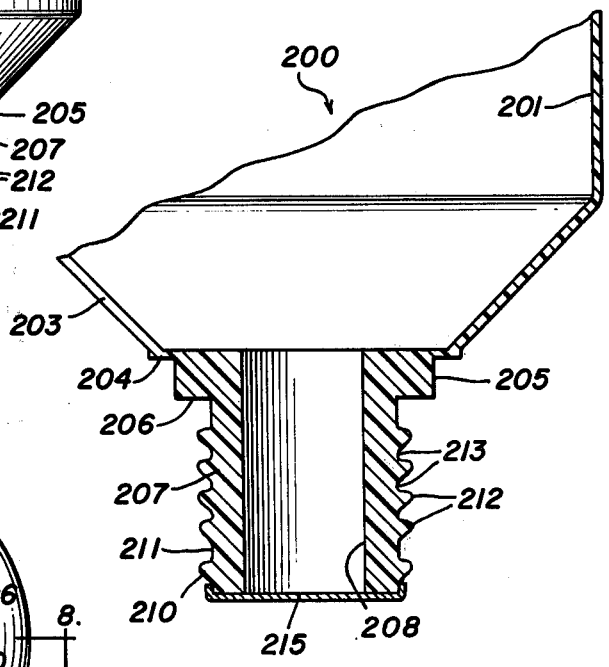
FIG. 7
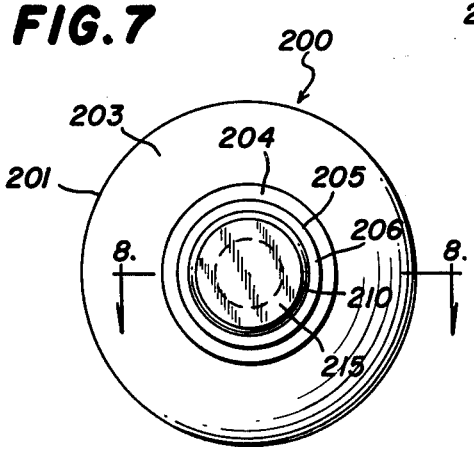

SOAP DISPENSING SYSTEM

This is a Division of application Ser. No. 719,924, filed Sept. 2, 1976, now abandoned.

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

There are currently known various types of liquid soap dispensers which consist of a combination of elements, which are generally fastened to a wall by means of screws or nails. In such prior art devices, the elements of the combination are so combined that whenever the apparatus breaks down or is damaged, it is necessary to remove the entire apparatus and to being it to a shop for necessary repair or servicing.

Furthermore, the soap-dispensing mechanism and/or the soap refilling openings of the apparatus are frequently accessible to users, whereby they may come in contact with the users' hands and will frequently become clogged or damaged, necessitating disassembly and removal of the apparatus for servicing. Furthermore, this accessibility of the soap-dispensing and soap-refilling apparatus renders the prior art devices susceptible to vandalism.

The supplier of the dispensing apparatus may also supply the liquid soap to be dispensed therefrom and, indeed, economically speaking, the sale of soap for the dispensing apparatus typically constitutes a most significant portion of the business. In addition, it is important that the supplier of the dispenser be able to control the type and quality of soap being dispensed therefrom, in order to insure that the dispenser will operate properly. However, prior art dispensers have had soap refill apparatus which permits anyone having access thereto to refill the dispenser with any type of liquid soap, whether or not supplied by the supplier of the dispenser, thus not only adversely affecting the volume of liquid soap sold by the supplier, but also rendering it impossible for the supplier to monitor the quality of the soap being dispensed, thereby aggravating maintenance problems.

SUMMARY OF THE INVENTION

Therefore, it is a general object of this invention to provide a liquid soap dispenser wherein the soap container and the dispensing apparatus and the refill apparatus are all part of a single unit which is demountable, as a unit, from a mounting bracket, it never being necessary to remove or otherwise disturb the mounting bracket.

More particularly, it is an object of this invention to provide an improved liquid soap dispenser wherein the soap-dispensing mechanism can be readily removed for servicing and/or replacement, without the necessity of removing any screws or other fasteners, whereby no tools are necessary.

Still another object of this invention is to provide an improved liquid soap dispenser of the type set forth, wherein the mounting bracket cooperates with the liquid soap container for concealing and protecting the dispensing mechanism.

In connection with the foregoing object, it is another object of this invention to provide a liquid soap dispenser of the type set forth, which further includes a cover plate which cooperates with the mounting bracket and the soap container for concealing and protecting the soap refill apertures, the cover being shaped to additionally provide an ashtray and cigarette holder.

These and other objects of the present invention are achieved in a soap dispenser comprising a mounting bracket adapted to be secured to an associated support surface and including a bearing wall and a support member extending therefrom and an aperture extending therethrough, a soap container having a mounting member engageable with the support member and a positioning member, the support member and the mounting member being shaped and dimensioned for cooperation when in engagement with each other to support the soap container, the positioning member being snugly receivable through the aperture after the support member and the mounting member have been engaged fixedly to position the soap container with respect to the mounting bracket, the support member and the aperture respectively cooperating with the mounting member and the positioning member immovably to hold the soap container against the bearing wall, and dispensing means carried by the soap container for dispensing soap therefrom.

Further features of the invention pertain to the particular arrangement of the parts of the liquid soap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 6 is a side elevational view of a soap refill bottle constructed in accordance with and embodying features of the present invention, for use in refilling the liquid soap dispenser of FIG. 1;

FIG. 7 is a bottom plan view of the soap refill bottle of FIG. 6;

FIG. 8 is an enlarged fragmentary view in vertical section taken along the line 8—8 in FIG. 7;

DESCRIPTION OF THE PREFERRED EMBODIMENT

Figure 1:
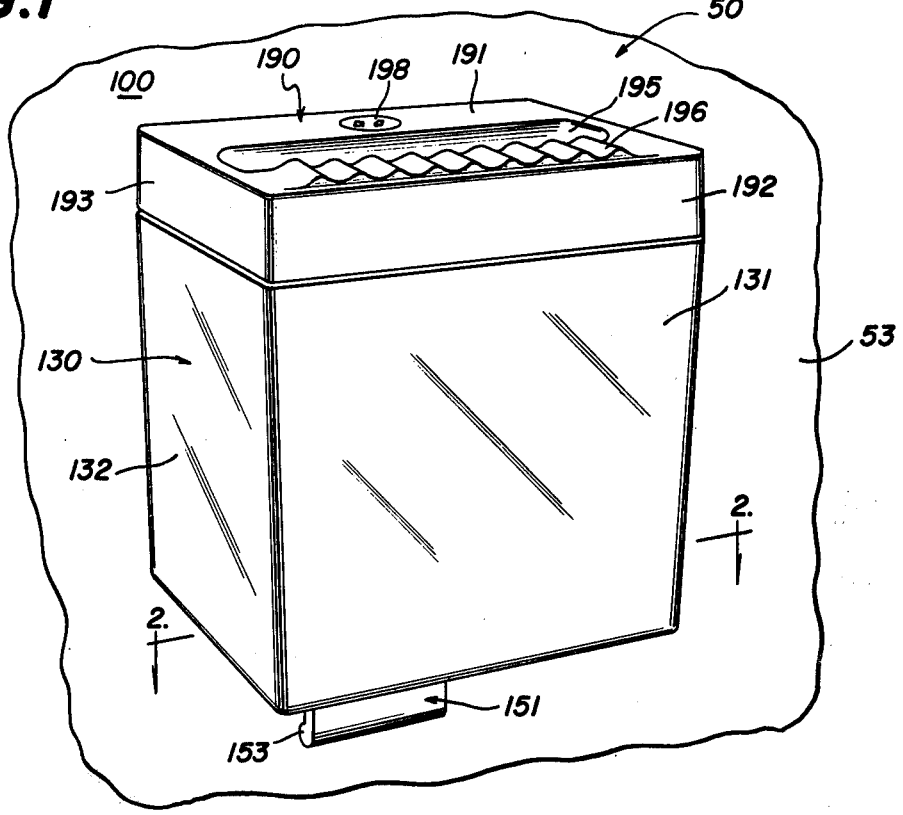
FIG. 1 is a front perspective view of a liquid soap dispenser constructed in accordance with and embodying the features of the present invention.
Figure 2:
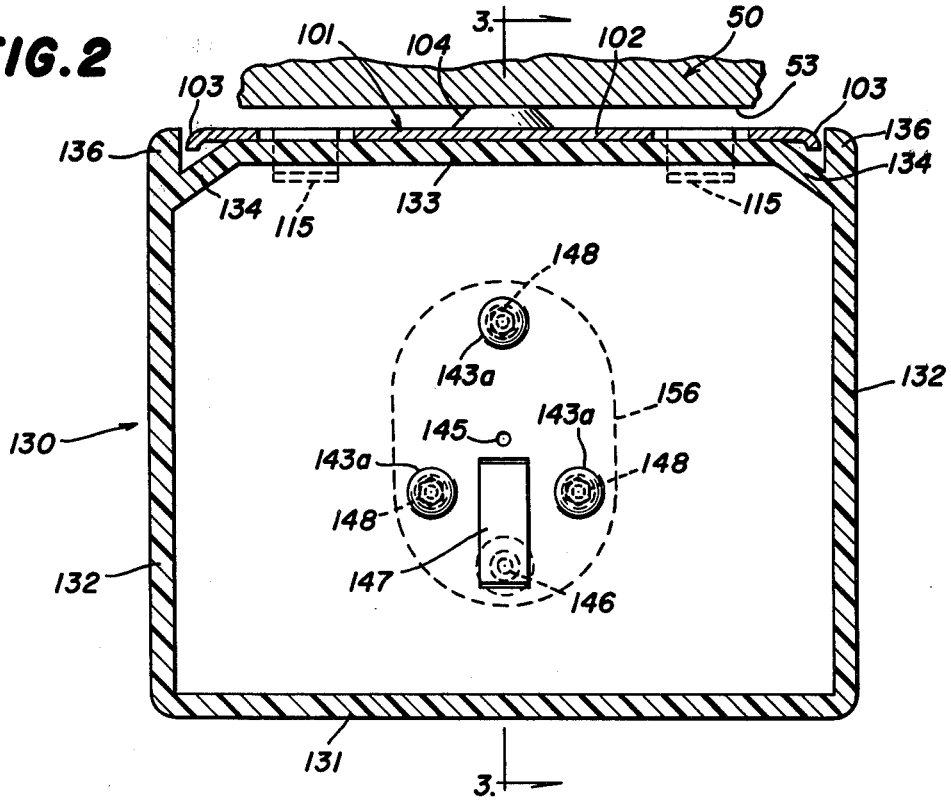
FIG. 2 is an enlarged view in horizontal section taken along the line 2—2 in FIG. 1.

Referring now to FIGS. 1 through 5 of the drawings, there is illustrated a soap dispenser, generally designated by the numeral 100, constructed in accordance with and embodying the features of the present invention. The soap dispenser 100 includes a mounting bracket, generally designated by the numeral 101, which includes a generally flat rectangular wall 102 disposed substantially vertically in use to provide a bearing surface, and having along each of the side edges thereof an integral curved side flange 103 which projects forwardly from the wall 102. Formed in the vertical wall 102 and projecting rearwardly therefrom in a direction away from the direction in which the side flanges 103 extend, are two substantially vertically aligned generally frustoconical embossments 104, each having an opening 105 extending therethrough centrally thereof. Also formed in the wall 102 and projecting rearwardly therefrom are two part-spherical embossments 106 which are disposed substantially in horizontal alignment with each other along the line disposed substantially midway between the embossments 104, with the embossments 106 projecting the same distance as the embossments 104. Also formed in the wall 102 adjacent to the upper edge thereof are two laterally spaced-apart substantially rectangular cutouts or openings 107.

The upper edges of the side flanges 103 join with the upper edge of the wall 102 to form a pair of shoulders 108. Integral with the wall 102 and extending laterally between the shoulders 108 is an extension flange 109 which is inclined forwardly in the same general direction as the side flanges 103, and which is integral at the distal end thereof with an upwardly extending flange 110 which is substantially parallel to the wall 102. The opposite side corners of the flange 110 are recessed to define two shoulders 111, there also being provided through the flange 110 two rectangular cutouts 112 and a small circular centrally disposed opening 113. Punched from the wall 102 adjacent to the lower end thereof are two forwardly and upwardly extending support fingers 115.

Integral with the bottom end of the wall 102 and extending forwardly therefrom substantially normal thereto is a wall 120 which is disposed substantially horizontally in use and is provided around the periphery thereof with an integral upturned flange 121 which is in turn integral with the side flanges 103. Integral with the wall 120 and projecting upwardly therefrom substantially normal thereto are two parallel and laterally spaced-apart pivot brackets 122, the portion of the wall 120 between the pivot brackets 122 being cut out to define a generally rectangular opening 123. Formed in the wall 120 adjacent to the forward edge thereof and substantially midway between the side edges thereof is a circular soap discharge opening 125, the purpose of the openings 123 and 125 being described more fully below.

In use, the mounting bracket 101 is mounted on a wall 50, generally above and closely adjacent to a sink or washbasin or the like. Mounting openings or holes 51 are formed in the wall 50 and may have screw fastening inserts 52 set therein. The mounting bracket is fixedly secured to the wall 50 by means of mounting screws 55 which are passed through the openings 105 in the embossments 104 and threadedly engaged in the inserts 52, the wall 102 being disposed substantially parallel to the surface 53 of the wall 50, and being in contact therewith only at the embossments 104 and 106, which serve to space the bracket 101 a slight distance from the surface 53 of the wall 50.

The dispenser 100 also includes a soap container or housing, generally designated by the numeral 130, which is preferably formed of plastic. The container 130 is generally box-like in configuration and includes a generally rectangular front wall 131, a pair of opposed side walls 132, a rear wall 133 and a rectangular bottom wall 135, the container 130 preferably being molded so that the walls 131, 132, 133 and 135 are all formed integrally with one another. The rear wall 133 is provided at the lateral side edges thereof with inturned forwardly inclined portions 134, and is provided at the upper end thereof with two laterally spaced-apart rearwardly extending rectangular projections 137. The side walls 132 have rearwardly extending portions 136 which project rearwardly beyond the rear wall 133, whereby the rear wall 133 is recessed with respect to the side walls 132. In addition, the rear wall 133 extends downwardly below the bottom wall 135 to form a downwardly extending portion or mounting flange 138. Similarly, the front wall 131 and side walls 132 all extend downwardly well below the bottom wall 135 and below the bottom edge of the mounting flange 138.

The walls of the container 130 cooperate to define therewithin a soap chamber, generally designated by the numeral 140 which, in use, is filled with liquid soap 141 to a predetermined level, such as 142. Formed in the bottom or outer surface of the bottom wall 135 are three cylindrical recesses 143, positioned generally at the corners of an imaginary triangle disposed substantially centrally of the bottom wall 135, the inner surface of the bottom wall 135 being provided with bosses **143*a* respectively above the recesses 143. Also formed in the inner surface of the bottom wall 135 is an elongated generally rectangular recess 144 which communicates with the space below the bottom wall 135 by a discharge conduit or opening 146 and by a supply conduit or opening 149. The outer end of the discharge opening 146 is surrounded by a boss 146*a*. Also extending through the bottom wall 135 substantially centrally thereof and adjacent to one end of the recess 144 is a suction conduit or opening 145, the outer end of which is surrounded by a boss 145*a*. The recess 144 is covered with and closed by a filler plate 147, so that the recess 144 does not communicate with the chamber 140, but rather communicates only with the outside of the container 130 by means of the openings 146 and 149. Respectively captured in the recesses 143 are three nuts 148**, for a purpose to be described more fully below.

Mounted below the bottom wall 135 of the container 130 is a pump assembly, generally designated by the numeral 150. The operation and construction of the pump assembly 150 is described in detail in my copending application Ser. No. 620,179, filed Oct. 6, 1975 and entitled "SOAP DISPENSER", now U.S. Pat. No. 4,018,363, issued Apr. 19, 1977, and assigned to the assignee of the present invention, the disclosure of which application is incorporated herein by reference. The pump assembly 150 includes an operating handle 151 provided with a pivot pin 152, the opposite ends of which are respectively mounted in the pivot brackets 122 on the mounting bracket wall 120 for pivotal movement of the operating handle 151 about the axis of the pin 152, which extends substantially horizontally above the bracket wall 120 substantially parallel thereto and to the bracket wall 102. The handle 151 projects in use downwardly through the opening 123 in the bracket wall 120 and terminates at the lower end thereof in an enlarged gripping portion 153. The handle 151 also includes a stop member 154 which projects rearwardly from the pin 152 above the housing wall 120, and an actuating arm 155 which projects forwardly from the pin 152 above the bracket wall 120 and is substantially longer than the stop member 154.

The pump assembly 150 also includes a unitary pump housing 156, which is preferably of molded construction. The pump housing 156 is provided with three apertures extending therethrough for respectively receiving three mounting screws 157, which respectively threadedly engage the nuts 148 for fixedly securing the pump housing 156 to the bottom wall 135 of the soap container 130. The pump housing 156 is provided with a delivery conduit 158 extending therethrough for communication with the discharge opening 146 in the container bottom wall 135. The pump housing 156 is also provided with a large opening 159 extending therethrough generally centrally thereof for communication with both the suction opening 145 and the supply opening 149 in the container bottom wall 135.

The pump assembly 150 is also provided with an obturator diaphragm, generally designated by the numeral 160, which is preferably formed of a flexible deformable material such as rubber or the like and, preferably, is substantially coextensive with the upper side of the pump housing 156. The peripheral edge of the diaphragm 160 is received in an accompanying recess in the pump housing 156, and the diaphragm 160 is securely sandwiched between the pump housing 156 and the container bottom wall 135, the diaphragm 160 having suitable screw openings 161 therethrough for accommodating the mounting screws 157.

The diaphragm 160 has a plurality of suction apertures 162 therethrough in surrounding relationship with the suction opening 145, and cooperating to define a central web portion which forms a suction obturator 164 disposed in use in contact with the boss 145*a* for closing the outer end of the suction opening 145. Similarly, the diaphragm 160 is provided with a plurality of discharge apertures 165 disposed in surrounding relationship with the supply opening 146 and cooperating to define a central web portion which forms a discharge obturator 167 disposed in use in engagement with the boss 146*a* for closing the discharge opening 146. Received in the opening 159 below the suction obturator 164 is a bowl 168 formed of flexible resilient material such as rubber, the bowl 168 being provided with a peripheral flange 169 which is fixedly secured to the pump housing 156 around the perimeter of the opening 159 for closing same.

In operation, the soap container 130 is mounted on the mounting bracket 101 by resting the mounting flange 138 on the support fingers 115 (see FIG. 3), and the rear wall 133 of the container 130 is placed flush against the wall 102 of the mounting bracket 101, with the rectangular projections 137 being respectively received snugly in the cutouts 107 in the bracket wall 102, for positioning the container 130 and preventing movement thereof in directions parallel to the bracket wall 102. When mounted in this position, the bracket wall 102 is received within the recess formed by the rearwardly extending portions 136 of the container side walls 132 so as to be substantially hidden from view, with the bottom of the flange 109 being at the level of the top edge of the container rear wall 133. The bottom wall 120 of the mounting bracket 101 is recessed within the bottom portions of the container front wall 131 and side walls 132, whereby the bracket bottom wall 120 is substantially concealed from view. Furthermore, the bracket bottom wall 120 and the lower end of the bracket wall 102 cooperate with the container mounting flange 138 and with the bottom ends of the container walls 131 and 132 for completely enclosing the pump housing 156, the opening 125 in the bracket bottom wall 120 being disposed immediately beneath the delivery conduit 158 of the pump housing 156 to permit delivery of liquid soap therethrough to a user.

The container 130 is also provided with a top wall 170 which is fixedly secured to the upper ends of the container walls 131, 132 and 133 for closing the upper end of the chamber 140, the top wall 170 having angled corners 171 at the rear end thereof which are respectively substantially parallel with the inturned portions 134 of the rear wall 133. Formed in the upper surface of the top wall 170 adjacent to the rear edge thereof is a narrow groove or recess 172. Also formed in the top wall 170 is a deep cylindrical depending well, generally designated by the numeral 175, which is provided with a generally cylindrical side wall 174 closed at the bottom end thereof by a circular bottom wall 176. The inner surface of the side wall 174 has an upper substantially right circular cylindrical portion 178 and a lower downwardly and inwardly sloping frustoconical portion 177, the portions 177 and 178 intersecting at a circular line 179 substantially midway between the upper and lower ends of the well 175.

Integral with the bottom wall 176 of the well 175 and projecting upwardly therefrom substantially centrally thereof is a piercing member, generally designated by the numeral 180, which comprises a cruciform arrangement of four flat blades or webs 181, respectively provided with knife edges 182 along the upper edges thereof which are inclined upwardly and inwardly to intersect at a point 183 a slight distance above the level of the dividing line 179. Formed in the bottom wall 176 and disposed between adjacent ones of the blades 181 are four groups of refill perforations or apertures 184 which extend through the bottom wall 176. It is a significant feature of the present invention that each of the refill apertures 184 has a cross sectional area such that liquid soap of the type to be dispensed from the dispenser 100 will not pass through the refill apertures 184 by gravity alone or, at best, will pass only very slowly therethrough. Integral with the top wall 170 and projecting upwardly therefrom adjacent to the front corners thereof are two lugs or ears 185, each being provided with an arcuate recess defining a retaining surface 186 in the forward edge thereof.

Pivotally secured to the inner surface of the upwardly extending flange 110 of the mounting bracket 101, as by a rivet 188 extending through the opening 113, is a small retaining plate 187, preferably formed of steel or the like. The retaining plate 187 extends downwardly to a point adjacent to the bottom end of the inclined flange 109. In use, when the container 130 is mounted on the mounting bracket 101, after the mounting flange 138 has been set upon the support fingers 115, as the container rear wall 133 is moved back against the bracket wall 102, the retaining plate 107 is pivoted upwardly out of the way to permit the top wall 170 to pass thereunder, and then when the container rear wall 133 is against the bracket wall 102 the retaining plate 107 is pivoted back down into engagement with the recess 172 for cooperation with the support fingers 115 securely to hold the container 130 in place and prevent it from tipping forward. It will be understood that, when it is desired to demount the container 130, the retaining plate 187 is pivoted back up to disengage it from the recess 172 and permit removal of the container 130. Thus, the container 130 can be readily mounted on and demounted from the mounting bracket 101 without having to handle any screws or other fasteners, and without the necessity of using any tools whatsoever.

The dispenser 100 is also provided with a cover plate, generally designated by the numeral 190, which includes a top wall 191, a front wall 192, a pair of opposed side walls 193 and a rear wall 194, all integrally connected in a unitary structure. Formed in the top wall 191 is a large bowl-like recess which serves as an ashtray 195 substantially centrally of the cover plate 190, the top wall 191 also having formed therein between the ashtray 195 and the front wall 192 a plurality of flutes 196 to serve as cigarette holders. Fixedly secured to the inner surface of the front wall 192 adjacent to the opposite side edges thereof are two projections 197 which are respectively adapted to be received in the arcuate recesses for engagement with the retaining surfaces 186 of the lugs 185 on the container 130. The cover plate 190 is dimensioned so as to completely cover the top wall 170 of the container 130, with the walls 192 through 194 having a depth sufficient to accommodate the inclined flange 109 and the upwardly extending flange 110 of the mounting bracket 101. In use, the projections 197 are inserted in the arcuate recesses 186 of the lugs 185, and the cover plate 190 is then pivoted down into position completely covering the top of the container 130, as illustrated in FIG. 3.

Preferably, the cover plate 190 is provided with a lock mechanism 198 which may be provided with atch fingers 196 adapted to extend through the apertures 112 in the mounting bracket flange 110, whereby the engagement of the latch fingers 196 with the bracket flange 110 and the engagement of the projections 197 with the lugs 185 cooperate securely to lock the cover plate 190 in place. It will be seen that when thus positioned on the container 130, the outer surfaces of the walls 192 through 194 are respectively substantially flush with the outer surfaces of the container walls 131 and 132 and the mounting bracket wall 101 to present substantially smooth uninterrupted outer surfaces for the dispenser 100, resulting in a clean, stylish appearance.

Figure 3:
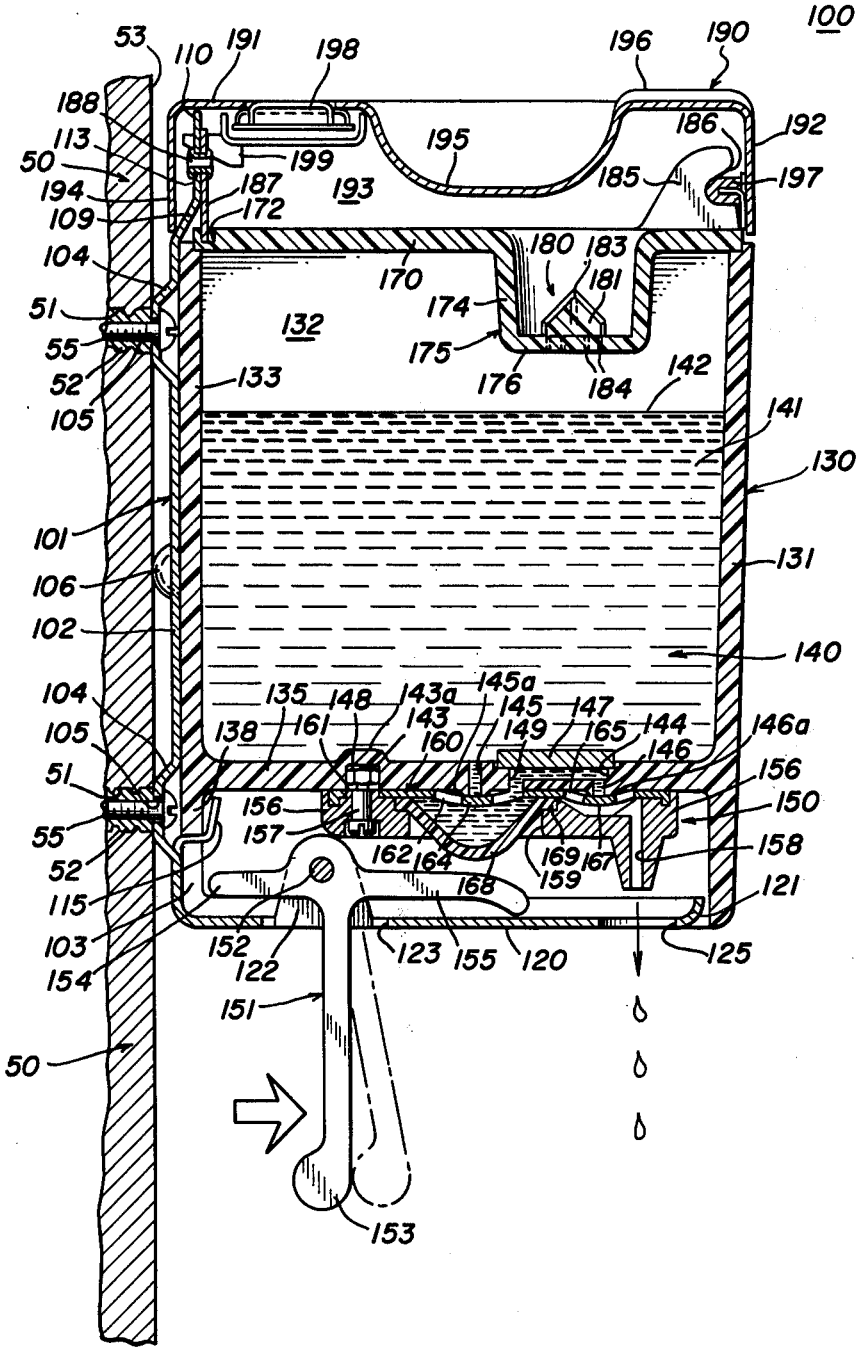
FIG. 3 is a view in vertical section taken along the line 3—3 in FIG. 2, and illustrating the internal construction of the soap dispenser.
Figure 4:
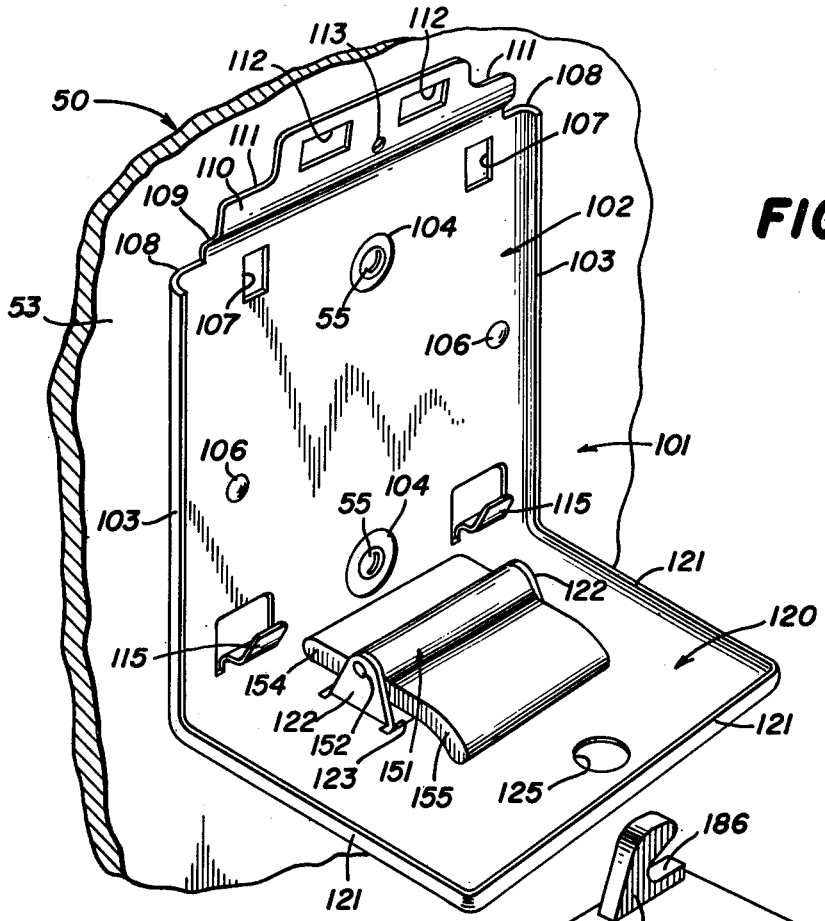
FIG. 4 is a front perspective view of the mounting bracket for the soap dispenser of the present invention, shown mounted in place on a supporting wall.
Figure 5:
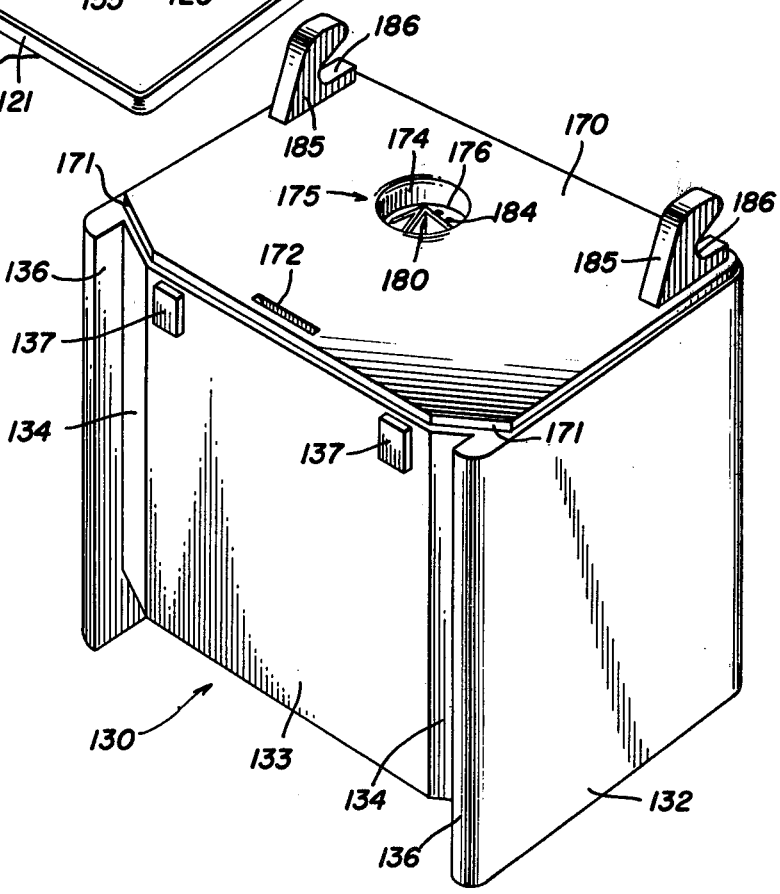
FIG. 5 is a rear perspective view of the liquid soap container of the present invention, shown demounted from the wall bracket and with the cover plate removed.
Figure 9:
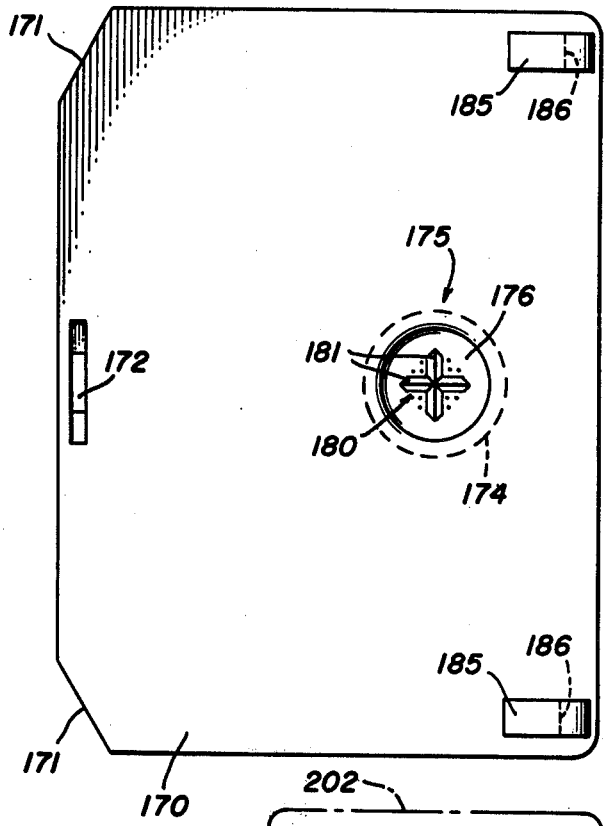
FIG. 9 is an enlarged top plan view of the liquid soap container of FIG. 5.
Figure 11:
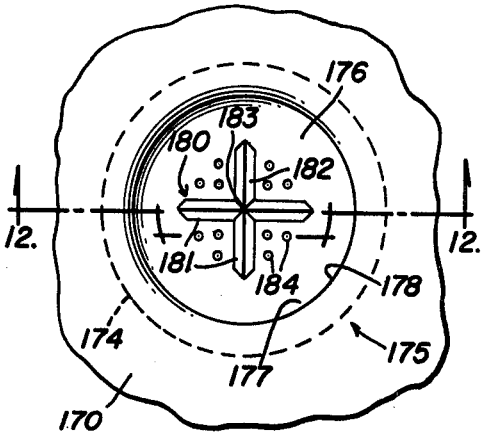
FIG. 11 is a further enlarged fragmentary top plan view of the soap refill well of the liquid soap container of FIG. 9.
Figure 12:
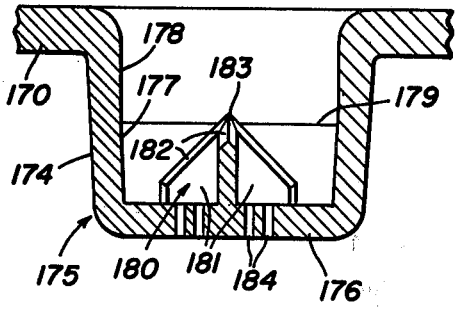
FIG. 12 is a fragmentary view in vertical section taken along the line 12—12 in FIG. 11.

In operation, when a user wishes to dispense soap from the dispenser 100, he pulls the handle 151 forwardly, in the direction of the arrow in FIG. 3, which brings the actuating arm 155 into engagement with the bowl 168 and compresses it to force the liquid soap contained therein upwardly through the supply opening 149 and the recess 144 and outwardly through the discharge opening 146, the pressure caused by compression of the bowl 168 forcing the discharge obturator 167 away from the boss **146*a* to allow the liquid soap to flow from the discharge opening 146 into the pump housing 158 and thence outwardly through the delivery conduit 158 and the mounting bracket opening 125 to the hands of the user. The compression of the bowl 168 also serves to force the suction obturator 164 more tightly against the boss 145*a* to prevent further liquid soap from passing through the suction opening 145 into the bowl 168. The movement of the actuating arm 155 is limited by engagement of the stop member 154 with the mounting bracket bottom wall 120**.

When the handle 151 is released, the weight of the actuating arm 155 pivots the handle 151 in a clockwise direction back to its original rest position, illustrated in solid line in FIG. 3. This clockwise movement of the handle 151 is further facilitated by the resilience of the flexible bowl 168, which tends to return to its normal position illustrated in FIG. 3, pushing the actuating arm 155 along with it. This return of the bowl 168 to its initial position exerts an aspirating or suction force on the diaphragm 160, which serves to pull the discharge obturator 167 back up into engagement with the boss **146*a* to close the discharge opening 146, while at the same time pulling the suction obturator 164 away from the boss 145*a* to open the suction opening 145 and allow a new charge of liquid soap to flow from the chamber 140 through the suction opening 145 into the bowl 168, thereby restoring the initial conditions in which the dispenser 100** is again ready for dispensing of another charge of liquid soap.

It is a significant feature of the present invention that the only portion of the pump assembly 150 which is accessible to a user is the handle 151, the remainder of the pump assembly 150 being completely enclosed by the container 130 and the mounting bracket 101. This not only enhances the appearance of the dispenser 100, but also serves to prevent a user from physically contacting the pump housing 156 and clogging the delivery conduit 158 thereof. In like manner, the cover plate 190 serves to enclose and protect the refill apertures 184 to prevent clogging thereof and to prevent contamination of the soap supply in the chamber 140. It will be understood that the cover plate 190 also serves to provide a convenient holder for a user's cigarette or other smoking material while he is washing his hands.

Referring now also to FIGS. 6 through 13 of the drawings, there is illustrated a refill cartridge or bottle, generally designated by the numeral 200, for use with the dispenser 100 to provide a complete liquid soap dispensing system. The refill bottle 200 is preferably in the form of a soft plastic squeeze-bottle and is adapted to hold a refill or supply of liquid soap for refilling the soap container 130 of the dispenser 100. The refill bottle 200 includes an elongated right circular cylindrical side wall 201 closed at one end thereof by a circular bottom wall 202, and having integrally connected thereto at the other end thereof an inwardly sloping frustoconical top wall 203 which terminates in a flat annular flange 204. Integral with the annular flange 204 at the inner edge thereof and extending therefrom coaxially with the cylindrical side wall 201 is a short cylindrical shoulder 205 which is substantially thicker and more rigid than the walls 201 through 203. Integral with the shoulder 205 at the distal end thereof is a radially inwardly extending annular flange 206 which is integral at the inner edge thereof with an elongated cylindrical neck 207 coaxial with the side wall 201, but being relatively thick-walled and substantially rigid, the neck 207 defining a cylindrical discharge passage 208 communicating with the interior of the refill bottle 200.

Integral with the outer surface of the neck 207 and extending radially outwardly therefrom is a first annular rib or flange 210 and a plurality of second annular ribs or flanges 212. The first flange 210 is disposed closely adjacent to the distal end of the neck 207, and is spaced from the nearest one of the second flanges 212 by a first space 211 extending axially of the neck 207 a relatively long first predetermined distance. The second flanges 212 are equidistantly spaced apart from one another by second predetermined spaces 213, each of which has an axial extent substantially less than that of the space 211. Adhesively secured to the neck 207 at the distal end thereof and closing the discharge passage 208 is a relatively thin circular membrane 215 impermeable to the liquid soap and which is secured across the distal end of the neck 207 after the refill bottle 200 is filled with liquid soap to prevent the soap from escaping from the refill bottle 200.

Figure 10:
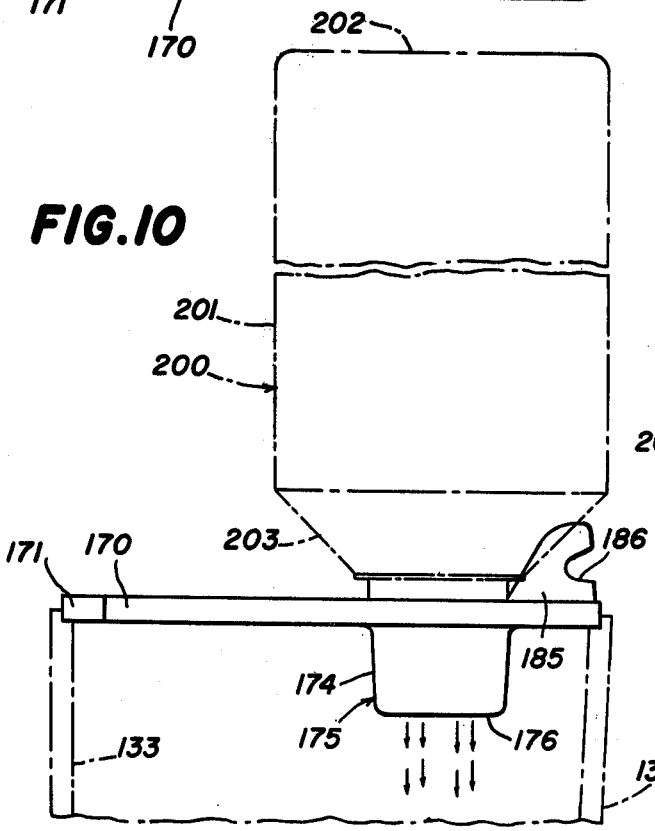
FIG. 10 is a fragmentary side elevational view of the soap refill well of the liquid soap container of FIG. 9, illustrating the cooperation thereof with the soap refill bottle during a refill operation.
Figure 13:
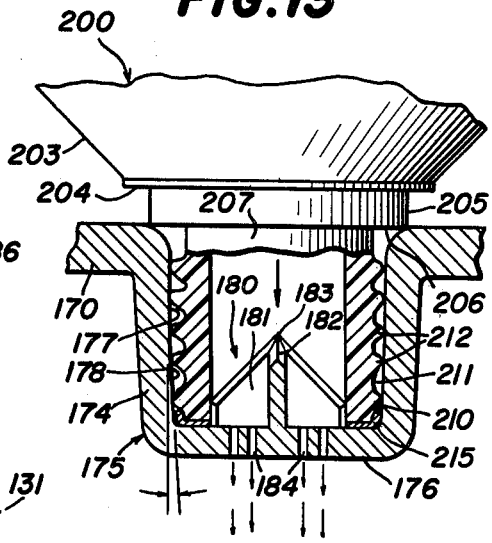
FIG. 13 is a view like FIG. 12, showing the refill bottle in engagement in the refill well during a refill operation.

When it is desired to refill the soap container 130 of the dispenser 100, the cover plate 190 is unlocked and removed to expose the refill well 175. The neck 207 of the refill bottle 200 is then inserted into the well 175 of the soap container 130, as best illustrated in FIGS. 10 and 13. In this regard, it will be noted that the maximum outer diameter of the flanges 210 and 212 are substantially equal to the diameter of the cylindrical inner surface portion 177 of the well side wall 174 so as to be disposed in frictional engagement therewith as the neck 207 is inserted into the well 175. As the flange 210 and the first of the flanges 212 come into contact with the inwardly sloping frustoconical portion 178 of the inner surface of the well side wall 174, the frictional interference therebetween become greater. However, the flanges 210 and 212, while being relatively rigid, are sufficiently flexible and resilient to permit insertion of the neck 207 all the way into the well 205 until the distal end of the neck 207 contacts the bottom wall 176 of the well 175.

It will be noted that the neck 207 is of such a length that, when the membrane 215 is in engagement with the bottom wall 176 of the well 175, the shoulder 205 is in engagement with the upper surface of the container top wall 170 around the periphery of the well 175. As the neck 207 is inserted into the well 175, the point 181 of the piercing member 180 pierces and ruptures the membrane 215 closing the neck 207 of the injection bottle 200, the piercing member 180 having a maximum outer diameter such that it is received into the discharge passage 208 of the neck 207. When the membrane 215 is thus ruptured, the liquid soap within the injection bottle 200 is permitted to flow therethrough around the piercing member 180 and to the refill apertures 184.

As was indicated above, the liquid soap will not flow through the apertures 184 by gravity. Thus, in order to inject the liquid soap through the refill apertures 184 and into the chamber 140, the refill bottle is squeezed, thereby applying greater than ambient pressure to the liquid soap therein and forcing it through the refill apertures 184. By reason of the interference fit between the inner surface of the well side wall 174 and the flanges 210 and 212 of the refill bottle neck 207, these members cooperate to form a substantially fluid-tight seal which prevents the liquid soap from flowing outwardly around the neck 207 and out of the well 175. When the refill bottle 200 has been emptied, it is removed from the well 175 and the cover plate 190 is locked back in place.

Thus, it will be appreciated that by reason of this unique refill arrangement, the soap container 130 may not be refilled except by the use of the special refill bottle 200 which is designed to uniquely cooperate with the well 175. This will effectively prevent a user of the dispenser 100 from using therein any soap other than that provided by the supplier of the dispenser 100. It will be noted that the piercing member 180 extends only a very slight distance above the frustoconical inner wall portion 178 of the well side wall 174. Thus, when the neck 207 has been inserted into the well 175 a sufficient distance for the piercing member 180 to pierce the membrane 215, the first annular flange 210 of the neck 207 will already be coming into engagement with the frustoconical portion 178 of the inner surface of the well side wall 174 to form an effective fluid-tight seal. Thus, while normally the neck 207 will be inserted into the well 175 in one quick continuous motion, even if the neck 207 should be momentarily stopped in a position half way down the well 175, there will be no leakage of liquid soap from the well 175.

In a constructional model of the dispenser 100, the mounting bracket 101, the pump housing 156; and the cover plate 190 are all preferably formed of metal, the soap container 130 is preferably formed of transparent plastic, the diaphragm 160 and bowl 168 are preferably formed of rubber, while the injection bottle 200 is preferably formed of a translucent plastic material and the membrane 215 is preferably formed of aluminum foil. However, it will be appreciated that any other suitable materials may be used in the construction of the liquid soap dispensing system of the present invention.

From the foregoing, it can be seen that there has been provided an improved liquid soap dispenser which can be readily mounted on and demounted from a wall bracket without the use of tools.

There has also been provided a dispenser of the character described wherein the dispensing pump mechanism and the refill apertures are completely enclosed so as to be protected and hidden from view.

In addition, there has been provided a unique liquid soap dispensing system which effectively prevents the use of unauthorized liquid soap for refilling the dispenser.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A soap dispenser comprising a mounting bracket adapted to be secured to an associated support surface and including a bearing wall and a support member extending therefrom adjacent to one end thereof and an opening extending therethrough adjacent to the opposite end thereof, a soap container having a mounting member engageable with said support member and a positioning member, said support member and said mounting member being shaped and dimensioned for cooperation when in engagement with each other to support said soap container for movement between a free position wherein said positioning member is disposed out of said opening and a mounting position wherein said positioning member is snugly received through said opening fixedly to position said soap container laterally with respect to said mounting bracket, said support member and said opening respectively cooperating with said mounting member and said positioning member to hold said soap container in position against said bearing wall, and dispensing means carried by said soap container for dispensing soap therefrom.

2. The soap dispenser set forth in claim 1, wherein said soap container has a recess formed in the top thereof, and further including a retaining member carried by said mounting bracket for movement between a retaining position engageable in said recess when said container is disposed against said bearing wall in the mounting position thereof for cooperation with said support member to prevent removal of said container from said mounting bracket and a release position out of engagement with said recess to permit removal of said container from said mounting bracket.

3. The soap dispenser set forth in claim 1, wherein said mounting member comprises a flange extending downwardly from the bottom of said soap container, and said support member comprises two support fingers projecting upwardly beneath said flange for supporting said soap container.

4. The soap dispenser set forth in claim 1, wherein said soap container is in the form of a generally rectangular hexahedron including a top wall and a bottom wall and a front wall and a rear wall and a pair of opposed side walls, said side walls extending rearwardly of said container beyond said rear wall and cooperating therewith to define a rear recess, said rear wall being disposed in use against said bearing wall so that said mounting bracket is received in said recess and is substantially hidden from view by said side walls.

5. The soap dispenser set forth in claim 1, wherein said mounting bracket includes a bottom wall extending in use away from said bearing wall and beneath said soap container in the mounted configuration thereof and cooperating therewith for enclosing said dispensing means, said bottom wall having an aperture therein for permitting the passage therethrough to a user of soap dispensed by said dispensing means.

6. The soap dispenser set forth in claim 5, and further including a manually operated actuating lever pivotally mounted on said bottom wall and projecting downwardly therefrom for manual operation by a user, said actuating lever being engageable with said dispensing means for effecting operation thereof.

7. A soap dispenser comprising a mounting bracket adapted to be secured to an associated support surface and including a bearing wall and a support member extending therefrom and an opening extending therethrough, a soap container having a mounting member engageable with said support member and a positioning member, said support member and said mounting member being shaped and dimensioned for cooperation when in engagement with each other to support said soap container for movement between a free position wherein said positioning member is disposed out of said opening and a mounting position wherein said positioning member is snugly received through said opening fixedly to position said soap container laterally with respect to said mounting bracket, said support member and said opening respectively cooperating with said mouting member and said positioning member immovably to hold said soap container in position against said bearing wall, dispensing means carried by said soap container for dispensing soap therefrom, a cover plate removably mountable in use over said soap container and said mounting bracket and including a rear wall extending behind said bearing wall and cooperating therewith securely to hold said container against said bearing wall, and latch means carried by said cover plate and engageable with said mounting bracket for latching said cover plate in place.

8. The soap dispenser set forth in claim 7, wherein said cover plate includes a recess therein which forms an ashtray, said cover plate further including a plurality of indentations adjacent to said ashtray recess and adaptable for holding cigarettes.

9. A soap dispenser comprising a mounting bracket adapted to be secured to an associated support surface and including a bearing wall and a support member extending therefrom adjacent to one end thereof and an opening extending therethrough adjacent to the opposite end thereof, a closed wall structure defining a soap container having a mounting member engageable with said support member and a positioning member, said support member and said mounting member being shaped and dimensioned for cooperation when in engagement with each other to support said soap container for movement between a free position wherein said positioning member is disposed out of said opening and a mounting position wherein said positioning member is snugly received through said opening fixedly to position said soap container laterally with respect to said mounting bracket, said support member and said opening respectively cooperating with said mounting member and said positioning member immovably to hold said soap container in position against said bearing wall, and dispensing means carried by said soap container for dispensing soap therefrom, said wall structure having a refill aperture therethrough dimensioned so that at ambient pressure liquid soap of the consistency to be dispensed flows therethrough by gravity only very slowly if at all, whereby in refilling said container liquid soap must be forced through said refill aperture under greater than ambient pressure.

10. A soap dispenser comprising a mounting bracket adapted to be secured to an associated support surface and including a bearing wall and a support member extending therefrom and an opening extending therethrough, a soap container having a mounting member engageable with said support member and a positioning member, said suport member and said mounting member being shaped and dimensioned for cooperation with in engagement with each other to support said soap container, said positioning member being snugly receivable through said opening after said support member and said mounting member have been engaged fixedly to position said soap container laterally with respect to said mounting bracket, said support member and said opening respectively cooperating with said mounting member and said positioning member immovably to hold said soap container in position against said bearing wall, dispensing means carried by said soap container for dispensing soap therefrom, a cover plate removably mountable in use over said soap container and said mounting bracket and cooperating therewith securely to hold said container against said bearing wall, and latch means carried by said cover plate and engageable with said mounting bracket for latching said cover plate in place, said soap container including two retaining ears projecting upwardly therefrom at the side thereof opposite said bearing wall and each having a retaining surface thereon, said cover plate having lugs respectively engageable with said retaining surfaces for cooperation with said retaining ears to prevent raising of said cover plate at the side thereof opposite said latch means.

11. A soap dispenser comprising a mounting bracket adapted to be secured to an associated support surface and including a bearing wall and a support member extending therefrom and an opening extending therethrough, a soap container having a mounting member engageable with said support member and a positioning member, said support member and said mounting member being shaped and dimensioned for cooperation when in engagement with each other to support said soap container, said positioning member being snugly receivable through said opening after said support member and said mounting member have been engaged fixedly to position said soap container laterally with respect to said mounting bracket, said support member and said opening respectively cooperating with said mounting member and said positioning member to hold said soap container in position against said bearing wall, dispensing means carried by said soap container for dispensing soap therefrom, said dispensing means including an outlet member, said mounting bracket further including a bottom wall extending in use away from said bearing wall and beneath said soap container in the mounted configuration thereof and cooperating therewith for enclosing said dispensing means, said bottom wall being spaced vertically from said outlet member and having an aperture therein for permitting the passage therethrough to a user of soap dispensed by said dispensing means from said outlet member, and a manually operated actuating lever pivotally mounted on said bottom wall and projecting downwardly therefrom for manual operation by a user, said actuating lever being engageable with said dispensing means for effecting operation thereof.

* * * * *

UNITED STATES PATENT AND TRADEMARK OFFICE

CERTIFICATE OF CORRECTION

PATENT NO. : 4,146,156

DATED : March 27, 1979

INVENTOR(S) : Antonio M. Cassia

It is certified that error appears in the above-identified patent and that said Letters Patent are hereby corrected as shown below:

Column 7, line 43, "atch" should be --latch--;
line 68, "158" should be --156--;
Column 11, line 60, "mouting" should be --mounting--.
Column 12, line 43, "with" should be --when--.

Signed and Sealed this

*Thirty-first* Day of *July 1979*

[SEAL]

*Attest:*

*Attesting Officer*

LUTRELLE F. PARKER
*Acting Commissioner of Patents and Trademarks*